United States Patent [19]

Bennett

[11] Patent Number: 4,505,400

[45] Date of Patent: Mar. 19, 1985

[54] SLIDE TYPE CAP CLOSURE

[76] Inventor: Robert A. Bennett, 170 Sturbridge Rd., Easton, Conn. 06425

[21] Appl. No.: 477,773

[22] Filed: Mar. 22, 1983

[51] Int. Cl.[3] ..... B65D 47/28

[52] U.S. Cl. ..... 215/250; 215/311; 215/322; 222/498; 222/559

[58] Field of Search ..... 215/311, 307, 322, 250; 222/498, 559, 561, 560; 220/345, 346, 347

[56] References Cited

U.S. PATENT DOCUMENTS 1,897,890 2/1933 Cook ..... 222/559 X
2,715,485 8/1955 Bernhardt ..... 222/498

FOREIGN PATENT DOCUMENTS 579486 9/1976 Switzerland ..... 222/561
1576126 10/1980 United Kingdom .

*Primary Examiner*—Donald F. Norton

*Attorney, Agent, or Firm*—Mattern, Ware, Stoltz & Fressola

[57] ABSTRACT

A slide type cap closure is disclosed comprising a cylindrically shaped closure member and a slidably interfitting disk member. The closure member forms a seal about the opening of the container on which it is mounted and includes an orifice extending upward from a recess formed along the top surface of the member. The recess has a pair of grooves extending along its length into which downwardly depending rails of the disk member slidably interfit. The disk member is dimensioned so as to move in a snap action manner along the upper surface of the closure member between open and closed positions. The disk member does not extend beyond the periphery of the closure member. The disk member in combination with the slightly protruding upper termination of the orifice forming member forms an extremely tight seal with the orifice when in the closed position.

36 Claims, 10 Drawing Figures

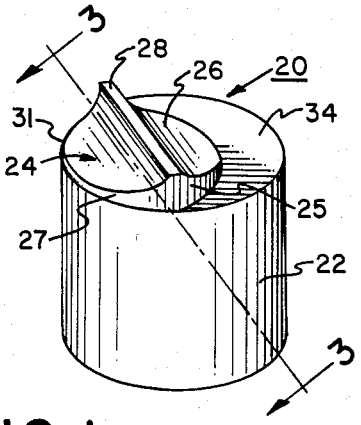
FIG. 1
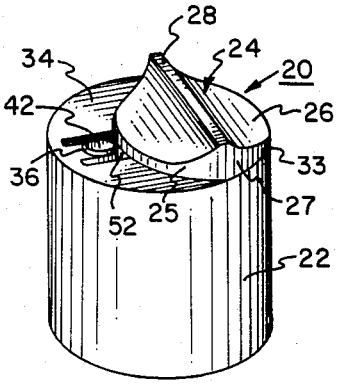
FIG. 2
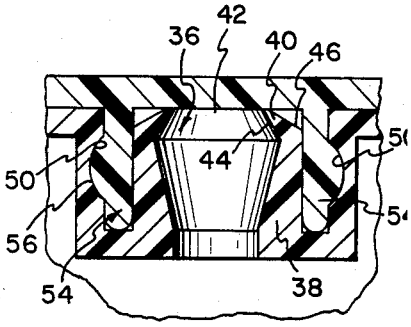
FIG. 3
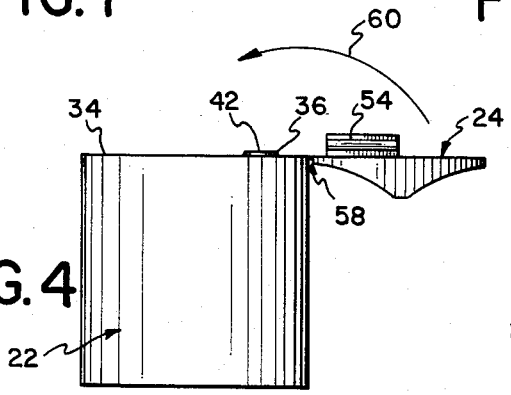
FIG. 4
FIG. 8
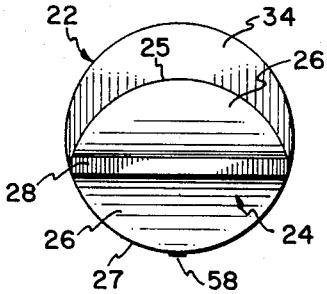
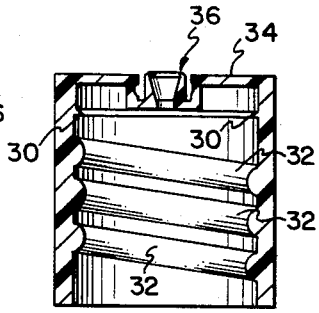
FIG. 6
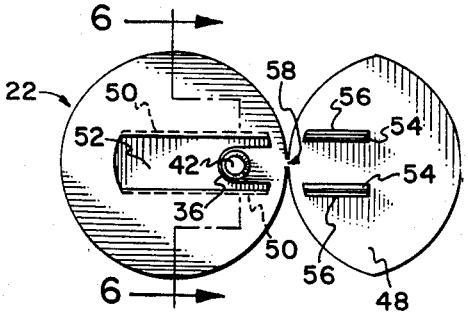
FIG. 5
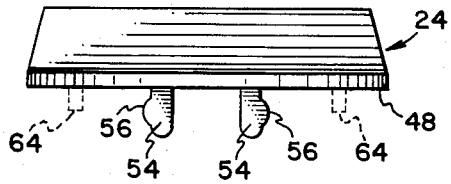
FIG. 7
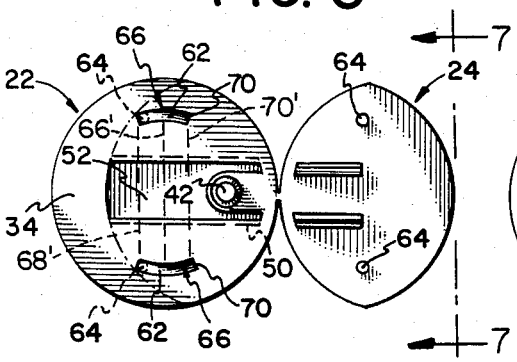
FIG. 9
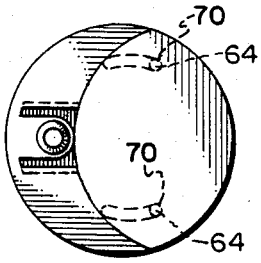
FIG. 10

SLIDE TYPE CAP CLOSURE

TECHNICAL FIELD

The present invention relates to closure devices for bottles and other types of containers or vessels which contain liquids or colloidal suspensions, including viscous liquids.

BACKGROUND ART

A number of closure devices have been in use providing a means to seal a vessel or container when not in use and to allow easy application of the material within the vessel when in an open position. Such closure devices are commonly used to seal vessels containing hand lotion, hand soaps, dishwasher detergents and other viscous materials. It is desirable that such closure devices be easy to operate, that they effectively seal the container against accidental spillage, and that they be attractive and inexpensive to manufacture.

One closure device which is presently manufactured contains a two-piece member, the first having an upper extending orifice forming member and the second piece slidably attached around this orifice forming member so as to move upward and downwardly with respect thereto and thereby respectively open and close the member. Such closure members are commonly used for dishwasher detergent. Due to the requirement that the second member be attached to the periphery of the first member, an assembly operation is required increasing the cost of the device.

Another closure device is manufactured by the Seaquist Company of Chicago, Ill. and is commonly known as a "living hinge" closure. This device is often used with hand lotion containers and has a centrally located orifice and a flap which is integrally attached to the closure cylinder so as to snap over the orifice when in a closed position and to maintain itself hinged away from the orifice when in an open position. Although manufactured as a single piece, the device is still somewhat expensive to manufacture because of the complicated nature of the "living hinge" arrangement.

The present invention is particularly suited as a closure device for containers of hand lotion, liquid detergent and other materials that have a somewhat viscous nature. The invention in addition can be used for virtually any type of liquid containing vessel, including liquids that are highly fluid (low viscosity) in consistency.

The present invention is inexpensive to manufacture since it may be molded in a single operation even though there are two parts which cooperate with each other to form the overall device. The invention includes a cylindrically shaped closure member which fits over the neck of the container used to store the fluid and a slidably interfitting disk member which mounts within a pair of grooves formed in the upper surface of the closure member. The closure member includes an upwardly extending orifice forming member whose termination lies in a plane slightly higher than that of the upper surface of the closure member. It is slightly depressed when the disk member rides over it so as to form an extremely tight seal both for shipping and for general storage purposes.

The disk member may further include a pair of downwardly depending pins which slidably interfit with two arcuate slots formed in the upper surface of the closure member so as to force the disk member to snap into either its open or closed position when it is manually moved. The snap action movement of the disk member insures that the device is securely in either the open or closed position and further indicates to the user that the device is operating properly. It has been found that a snap action closure device makes the device not only easier to use but also more desirable to use.

Since the closure device can be manufactured as a single piece, manufacturing costs are minimized. Indeed the device can be formed so that the disk member is attached at one point to the closure member when first and so that the purchaser has a visual indication that the container has not been tampered with since manufacture.

DISCLOSURE OF THE INVENTION

A slide type cap closure is disclosed comprising two components which slidably interfit with each other so as to form a snap action closure device. The first member is a cylindrically shaped closure member which fits over the neck of the vessel which contains the material which is to be dispensed. Although in most embodiments the closure member is cylindrically shaped, it of course may take on other shapes to conform with the dimensions of the vessel opening.

The upper surface of the closure member is generally planar and includes an orifice which extends upwards slightly above the surface of the closure member. The upper surface of the orifice forming member is shaped so as to be resiliently depressible when the second portion of the cap closure, the disk member, slides over it. In this way, an extremely tight seal is maintained between the orifice forming member and the disk member which effectively seals the entire vessel.

The closure member upper surface also includes a pair of undercut grooves extending a distance sufficient to allow the disk member to slide between a closed position which completely overlies the orifice forming member, and an open position which is beyond the orifice forming member. Downwardly depending rails on the disk member slidably interfit with the grooves to securely attach the disk member to the closure member while allowing it to slide between its open and closed positions.

To obtain a snap action effect between the open and closed positions of the disk member, the closure member includes a pair of opposed arcuate grooves positioned about the parallel grooves and into which a pair of downwardly depending pins formed in the disk member slidably interfit. Due to the fulcrum effect of these two opposed arcuate grooves, the pins of the disk member are forced to flex about the fulcrum as the disk member is moved between the open and closed positions. This results in a snap action effect.

In summation, the slide type cap closure is durable, easy to operate, attractive and inexpensive to manufacture.

OBJECTS OF THE INVENTION

Therefore it is a principal object of the present invention to provide a slide type cap closure incorporating a closure member for sealing the open portion of a container and for allowing the sliding movement of a disk member with respect to the closure member to open and close an orifice without the disk member extending beyond the top surface of the closure member.

Another object of the present invention is to provide a slide type cap closure as previously described in which the upper surface of the closure member includes a pair of longitudinally spaced grooves into which the disk member slidably interfits by means of a pair of downwardly depending rails which have transverse projections for interfitting with the grooves of the closure member.

A further object of the present invention is to provide a cap closure of the above description in which a snap action effect is obtained between the open and closed positions of the disk member by incorporating a pair of opposed arcuate grooves in the upper surface of the closure member to which downwardly depending pins of the disk member slidably interfit.

A still further object of the present invention is to provide a slide type cap closure of the above description in which the orifice forming member of the closure member extends slightly above the planar surface of the closure member and is dimensioned for resiliently contacting the lower surface of the disk member when the disk member is in its closed position.

A still further object of the present invention is to provide a slide type cap closure of the above description in which the overall device can be molded in a single operation with the disk member and cap closure member attached to each other at a single location; whereby the disk member can be inverted along this contact location so as to be in its closed position with respect to the closure member for initial sealing of the container during shipment and to indicate to the user that the device has not been tampered since manufacture.

A further object of the present invention is a cap closure of the above description wherein the molding contact point between the disk member and closure member is easily broken by the user the first time the disk member is moved to the open position.

Further objects of the present invention will in part be obvious and will in part appear hereinafter.

DRAWINGS

For a fuller understanding of the nature and objects of the present invention, reference should be made to the following detailed description taken in connection with the accompanying drawings, in which:

FIG. 1 is a perspective view of the slide type cap closure showing the upper disk member in the closed position with respect to the lower closure member.

FIG. 2 is a perspective view of the slide type closure device similar to the view in FIG. 1, but showing the disk member in the open position.

FIG. 3 is a cross-sectional view taken along line 3—3 of FIG. 1 showing the depression of the orifice forming member when the disk member is in the closed position.

FIG. 4 is a side elevational view of the closure device in the embodiment wherein it is molded in a single operation with the disk member attached to the closure member at a single location.

FIG. 5 is a top plan view of the closure device similar to that shown in FIG. 4, with the disk member attached to the closure member.

FIG. 6 is a cross-sectional view of the closure member taken along line 6—6 of FIG. 5 illustrating that the orifice forming member of the closure member extends above the planar upper surface of closure member when the device is in the open position.

FIG. 7 is a side view of the disk member taken along line 7—7 in FIG. 9.

FIG. 8 is a top plan view of the closure device with the disk member in the closed position FIG. 9 is a top plan view of the closure device similar to FIG. 5 and in addition showing the embodiment wherein the closure member has a pair of opposed arcuate grooves or slots into which the disk member interfits by means of a pair of depending pins so as to form a snap action movement of the disk member as it is moved between its open and closed positions.

FIG. 10 is a top plan view of the closure device showing the disk in its open position and in phantom showing the position of its pins when in this position.

BEST MODE FOR CARRYING OUT THE INVENTION

As best seen in FIGS. 1 and 2, a sliding type cap closure 20 comprises two primary components; namely, a closure member 22 and a disk member 24. The closure member 22 is generally cylindrical in shape and is designed for mounting to a neck of a bottle (bottle, vessel and containers are used interchangeably in this overall specification) so as to sealingly interfit with the bottle by means of a crab claw seal 30 as best seen in FIG. 6. Such a seal is well known in the closure art. The interior of the closure as shown in FIG. 6 may include screw threads 32 for mating with corresponding threads on the neck of the container or vessel. The particular arrangement for mounting the closure member to the vessel may vary from vessel to vessel depending upon the configuration of the vessel's neck. It is preferable however, that mounting of the closure member to the neck of the vessel use the crab claw so as to maintain a tight seal with the vessel's neck. It should also be realized that although the preferred embodiment of the present invention uses a closure member having a hollow cylindrical shape, that this shape may of course be varied to correspond to the cross-sectional shape of the vessel's neck in situations where non-cylindrical necks are employed.

As seen in FIGS. 2–6, the closure member has a generally planar upper surface 34. In addition, the closure member incorporates an orifice forming member 36 which protrudes above the planar surface 34 as best seen in FIGS. 2, 4 and 6. The orifice forming member generally designated by the numeral 36, actually comprises two different geometrically shaped annular wall portions as best seen in FIGS. 3 and 6. The first wall portion 38 has an inner surface that tapers upwardly and radially outwardly while the second wall portion 40 has inner and outer surfaces that taper upward and radially inwardly. The second wall portion 40 has an interior wall 44 which defines an angle with the vertical (that is with the axis of the orifice forming member 36) of approximately 30 degrees while the outer surface 46 of the second wall portion defines a corresponding angle of approximately 45 degrees. These angular relationships provide for resilient downward movement of the second wall 40 of the orifice forming member 36 when the disk member 24 rides over the orifice forming member. In this way, an extremely tight seal is maintained between the lower planar surface 48 of disk member 24 and the upper terminus of the orifice forming member 36.

The closure member 22 further incorporates a pair of parallel grooves 50 which extend along the length of an upper cutout region 52. These grooves are best seen in FIGS. 3 and 5. In the preferred embodiment of the invention, a preferable recess for these grooves is 0.008 inch (0.019 centimeter). This and other preferred dimensions for the preferred embodiments of the inventions shown in the FIGURES are presented in Table 1.

As will be explained below, the parallel grooves 50 are used to slidably capture the disk member 24 and thereby provide for easy operation of the disk member.

As best seen in FIGS. 1–6, the disk member 24 preferably has a raised upper surface 26 terminating along a ridge 28 so as to facilitate easy manual movement of this member between its closed position as shown in FIG. 1 and its open position as shown in FIG. 2. The disk member has a substantially flat lower planar surface 48 for contacting the planar upper surface 34 of closure member 22. As best seen in FIGS. 5 and 8 the disk member perimeter has two arcuate edges 25 and 27, each preferably having a radius of curvature substantially the same as that for the perimeter of closure member surface 34. In this way a smooth edge is obtained for the closure member-disk member combination as the disk member is moved between the closed and open positions. FIGS. 1 and 2 illustrate the resulting smooth edge at locations 31 and 33.

In order to maintain the disk member on the closure member, the disk member incorporates a pair of downwardly depending rails 54 as best seen in FIGS. 3, 4, 5 and 7.

TABLE 1

| | INCH | CENTIMETER |
|---|---|---|
| Recess of grooves 50 | .008 | .020 |
| Depth of rails 54 | .10 | .25 |
| Depth of pins 64 | .06 | .15 |
| Protrusion of orifice forming member above surface 34 | .005 | .01 |
| Depth of cutout 52 | .105 | .267 |

These rails each include an outwardly projecting bead or ridge 56 for interfitting with the undercut parallel grooves 50 in the closure member. This cooperation is best seen in FIG. 3. Through use of the ridge and groove arrangement, the disk member, once mounted within the grooves, is able to securely slide along the grooves. Manual removal of the disk member is thus virtually impossible.

Furthermore, due to the size of the disk member surface 24 with respect to closure member surface 34, the disk member never extends beyond the closure member. This is highly advantageous since it eliminates the chance of accidental upward prying of the disk member from the closure member.

As explained earlier, when the disk member is in the closed position, its lower planar surface 48 forces the second wall portion 40 of the orifice forming member 36 to be pushed downward so as to be substantially coplanar with the planar surface 34 of the closure member. An extremely tight contact is thus made between the lower planar surface 49 of the disk member and the upper terminus of the orifice forming member thereby virtually eliminating any leakage with respect to the fluid contained within the vessel.

As best seen in FIGS. 4 and 5 the closure member 22 and the disk member 24 may be integrally molded in an injection molded process, preferably using a polypropylene type polymer. The two components are combined together by a small connecting tab 58 formed during the molding operation. This greatly facilitates fabrication of the device since the disk member 24 is properly aligned with the closure member when it is rotated about tab 58 in the direction of arrow 60 (see FIG. 4). It also seals the orifice 42.

If the disk member is inverted onto the closure member while the polymer is still at an elevated temperature following fabrication, the tab will flex and not fracture. In this manner the tab indicates to the purchaser whether the container has been tampered with since manufacture. The purchaser when he or she first uses the closure device breaks tab 58 when moving disk member 24 from the closed to open position of seen in FIGS. 1 and 2.

If the disk member is inverted after the polymer has cooled, the connecting tab will fracture. This may be advantageous for some packaging situations.

In a second embodiment of the present invention as seen in FIGS. 9 and 10, a snap action movement of the disk member between its closed and open positions is obtained through use of opposed arcuate grooves 62 formed in the planar surface 34 of closure member 22. Pins 64 in disk member 24 project downwardly into the grooves when the disk is mounted to the closure member. This alignment is best seen in FIGS. 9 and 10. Pins 64 are also shown in phantom in FIG. 7 for this embodiment of the present invention.

The pins ride within grooves 62 as seen in FIGS. 9 and 10 and tend to force the cap closure to remain in either the open or closed position due to the fulcrum effect of the opposed arcuate grooves 62. That is due to the change in transverse distance as the pins move in the grooves between end 68 and 70 corresponding to when the disk is in the closed or open positions respectively. The maximum transverse distance is visually presented by line 66' while the minimum distances are shown by lines 68' and 70'. By movement of the pins within arcuate grooves 62 and the fulcrum effect described above, a snap type sound is obtained when the disk is moved with a corresponding tactile feel of the snapping action. Both the sound and the feel have been found to be advantageous with respect to the closure device since it insures that the device is in the either full open or closed position as well as giving the user the aural and tactile feedback of such movement.

Although the arcuate grooves and corresponding pins are shown providing such a snap action effect, other arrangements may be used to effectuate the same result; such as causing the disk member to override a surface discontinuity on the upper surface of the closure member or some discontinuity or protuberance within the cutout region 52 in the closure member. The arcuate grooves however have been found to be the most expeditious way of obtaining the snap action effect and are therefore disclosed in the best mode for carrying out the invention.

Thus what has been described is a new type of slide action closure member which can be used with virtually any type of fluid, including viscous fluids commonly used for hand lotions, dishwasher detergent and other household items. The closure device incorporates two components, a closure member and a disk member in which the disk member slidably interfits with the closure member so as to seal or unseal an orifice forming member in the closure member. The device can include means for obtaining a snap action effect so as to give both aural and tactile feedback to the user and can also be fabricated in a single molding operation to minimize fabricating expense as well as to visually indicate to the purchaser that the closure member has not been tampered with between the time of manufacture and the time of purchase.

It will thus be seen in the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is to be understood that the following claims are intended to cover all of the generic and specific features of the invention herein described, and all statements of the scope of the invention which, as a matter of language, might be said to fall therebetween.

Having described the invention, what is claimed is:

1. A slide type closure device for mounting to a vessel containing a fluid, the vessel having an open neck for passage of the fluid, the closure device to seal the vessel when the device is in a closed position and to allow dispensing of the fluid when the device is in an open position, comprising:

(A) A closure member having means for sealing attachment to the neck portion of the vessel, said member having an upper substantially planar surface and an orifice forming member extending upwardly above the planar surface, and further comprising a pair of substantially parallel grooves formed within a recess in the planar upper surface of the closure member for slidably capturing a second member; and (B) a disk member as said second member having a lower substantially planar surface for contacting a portion of the planar upper surface of the closure member, the disk member comprises a pair of downwardly depending rails each having a transversely projecting ridge for interfitting with one of the grooves in the closure member so as to be able to slide across at least a portion of the closure member planar surface without extending beyond the closure member planar surface, and further to sealingly depress the orifice forming member when the disk member is in the first closed position and to substantially unobstruct the orifice formed within the orifice forming member when the disk member is in the second open position.

2. A slide type closure device as defined in claim 1 wherein the orifice forming member comprises an upward radially inward projecting wall having an outer surface subtending a more acute angle with the axis of the orifice than the inner surface of the wall so as to allow resilient flexing of the orifice forming member as the disk member slidably overrides the orifice forming member; thereby insuring a tight seal between the disk member and the closure member.

3. A slide type closure device as defined in claim 2 wherein the closure member further incorporates in its planar surface a pair of opposed arcuate grooves and wherein the disk member further comprises a pair of downwardly depending pins dimensioned for receipt in the arcuate grooves of the closure member so as to cause a snap action effect as the disk member is moved between its open and closed positions.

4. A slide type closure device as defined in claim 3 wherein the closure member is substantially cylindrical in shape, has a interior thread for engaging with the neck of the vessel and has a crab claw type seal positioned near the upper interior terminus of the member so as to sealingly interfit with the neck of the vessel.

5. A slide type closure device as defined in claim 4 further comprising a connecting tab integrally formed between the closure member and the disk member.

6. A slide type closure device as defined in claim 5 wherein the closure member and disk member are formed from an injection molded polypropylene type polymer and wherein the connecting tab is maintained in an unfractured state by pivotally rotating the disk member onto the closure member while the polypropylene polymer is still at an elevated temperature so as to allow the connecting tab to be a tamper evidence indicator.

7. A slide type closure device as defined in claim 5 wherein the closure member and disk member are manufactured from a polypropylene polymer and further wherein the connecting tab is fractured upon assembly of the disk member to the closure member by allowing the polypropylene polymer to cool before mounting of the disk member onto the closure member.

8. A slide type closure device as defined in claim 7 wherein the closure member planar surface has a substantially circular perimeter and wherein the disk member also has a substantially circular perimeter with a diameter less than that of the closure member planar surface by at least the diameter of the orifice forming member.

9. A slide type closure device as defined in claim 8 wherein the disk member has an upwardly projecting transverse ridge to facilitate manual movement of the disk member.

10. A slide type closure device as defined in claim 9 wherein the disk member periphery comprises two arcuate sections each having a radius of curvature substantially the same as that of the closure member planar surface perimeter.

11. A slide type closure as defined in claim 1, further wherein the axial length of the orifice forming member is slightly greater than the orifice diameter.

12. A slide type closure device as defined in claim 1 wherein the disk member periphery comprises two arcuate sections each having a radius of curvature substantially the same as that of the closure member planar surface perimeter.

13. A slide type closure device as defined in claim 1 wherein the closure member further incorporates in its planar surface a pair of opposed arcuate grooves and wherein the disk member further comprises a pair of downwardly depending pins dimensioned for receipt in the arcuate grooves of the closure member so as to cause a snap action effect as the disk member is moved between its open and closed positions.

14. A slide type closure device as defined in claim 13 further comprising a connecting tab integrally formed between the closure member and the disk member.

15. A slide type closure device as defined in claim 14 wherein the closure member and disk member are formed from an injection molded polypropylene type polymer and wherein the connecting tab is maintained in an unfractured state by pivotally rotating the disk member onto the closure member while the polypropylene polymer is still at an elevated temperature so as to allow the connecting tab to be a tamper evidence indicator.

16. A slide type closure device as defined in claim 15 wherein the closure member planar surface has a substantially circular perimeter and wherein the disk member also has a substantially circular perimeter with a diameter less than that of the closure memb.er planar surface by at least the diameter of the orifice forming member.

17. A slide type closure device for mounting to a vessel containing a fluid wherein the vessel has an open neck for passage of the fluid therethrough, the closure device to seal the vessel when the device is in a closed position to allow the dispensing of the fluid when the device is in an open position, comprising:

(A) a closure member having means for sealing attachment to the neck portion of the vessel, the member having an upper substantially planar surface incorporating (1) an upstanding orifice member extending upwardly above the planar surface, (2) means for slidably capturing a second member, and (3) a pair of opposed arcuate grooves formed in the planar surface; and (B) a disk member having a lower substantially planar surface for contacting a portion of the planar upper surface of the closure member, the disk member having means for engaging the capture means of the closure member so as to be able to slide across at least a portion of the closure member planar surface so as to sealingly depress the orifice forming member when the disk member is in the first closed position and to substantially unobstruct the orifice formed in the orifice forming member when the disk member is in the second opened position, and further comprising a pair of downwardly depending pins dimensioned for receipt in the arcuate grooves of the closure member so as to cause a snap action effect as disk member is moved between its open and closed positions.

18. A sliding type closure device as defined in claim 17 wherein the orifice forming member comprises an upward radially inward projecting wall having an outer surface subtending a more acute angle with the axis of the orifice than the inner surface of the wall so as to allow resilient flexing of the orifice forming member as the disk member slidably overrides the orifice forming member; thereby insuring a tight seal between the disk member and the closure member.

19. A slide type closure device as defined in claim 18, further comprising a connecting tab integrally formed between the closure member and the disk member.

20. A slide type closure device as defined in claim 19 wherein the closure member and disk member are formed from an injection molded polymer and wherein the connecting tab is maintained in an unfractured state by pivotally rotating the disk member onto the closure member while the polymer is still at an elevated temperature so as to allow the connecting tab to be a tamper evidence indicator.

21. A slide type closure device for mounting to a vessel containing a fluid, the vessel having an open neck for passage of the fluid, the closure device to seal the vessel when the device is in a closed position and to allow dispensing of the fluid when the device is in an open position, comprising:

(A) a closure member having means for sealing attachment to the neck portion of the vessel, said member having an upper substantially planar surface and further incorporating an orifice forming member extending upwardly above the planar surface, said orifice forming member comprising an upward projecting radially inward directed tapered wall defining the orifice opening at a first end and terminating at its other end with the remainder of the orifice forming member, said first end having a thinner wall thickness than said member's other end so as to allow said member to be resiliently flexible in a downward direction along the axis perpendicular to the plane of the orifice, said closure member further comprising means for slidably capturing a second member; and (B) a disk member as said second member, having a lower substantially planar surface for contacting a portion of the planar upper surface of the closure member, the disk member having depending means for engaging the capture means of the closure member so as to be able to slide across at least a portion of the closure member planar surface without extending beyond the closure member planar surface, said depending means in combination with a portion of the lower substantially planar surface, sealingly depressing the orifice forming member when the disk member is in the first closed position and substantially unobstructing the orifice formed in the orifice forming member when the disk member is in the second open position.

22. A slide type closure device as defined in claim 21 wherein the closure member further incorporates in its planar surface a pair of opposed arcuate grooves and wherein the disk member further comprises a pair of downwardly depending pins dimensioned for receipt in the arcuate grooves of the closure member so as to cause a snap action effect as the disk member is moved its open and closed positions.

23. A slide type closure device as defined in claim 22 wherein the closure member is substantially cyindrical in shape, has an interior thread for engaging with the neck of the vessel and has a crab claw type seal positioned near the upper interior terminus of the member so as to sealingly interfit with the neck of the vessel.

24. A slide type closure device as defined in claim 23 further comprising a connecting tab integrally formed between the closure member and the disk member.

25. A slide type closure device an defined in claim 24 wherein the closure member and disk member are formed from an injection molded polypropylene type polymer and wherein the connection tab is maintained in an unfractured state by pivotally rotating the disk member onto the closure member while the polypropylene polymer is still at an elevated temperature so as to allow the connecting tab to be a tamper evidence indicator.

26. A slide type closure device as defined in claim 24 wherein the closure member and disk member are manufactured from a polyproplene polymer and further wherein the connecting tab is fractured upon assembly of the disk member to the closure member by allowing the polypropylene polymer to cool before mounting of the disk member onto the closure member.

27. A slide type closure device as defined in claim 26 wherein the closure member planar surface has a substantially circular perimeter and wherein the disk member also has a substantially circular perimeter with a diameter less that that of the closure member planar surface by at least the diameter of the orifice forming member.

28. A slide type closure device as defined in claim 27 wherein the disk member has an upwardly projecting transverse ridge to facilitate manual movement of the disk member.

29. A slide type closure device as defined in claim 28 wherein the disk member periphery comprise two arcuate sections each having a radius of curvature substantially the same as that of the closure member planar surface perimeter.

30. A slide type closure device as defined in claim 21 wherein the disk member periphery comprises two arcuate sections each having a radiusof curvature substantially the same as that of the closure member planar surface perimeter.

31. A slide type closure device as defined in claim 21 wherein the closure member further incorporates in its planar surface a pair of opposed arcuate grooves and wherein the disk member further comprises a pair of downwardly depending pins dimensioned for receipt in the arcuate grooves of the closure member so as to cause a snap action effect as the disk member is moved between its open and closed positions.

32. A slide type closure device as defined in claim 31 further comprising a connecting tab integrally formed between the closure member and the disk member.

33. A slide type closure device as defined in claim 32 wherein the closure member and disk member are formed from the connecting tab is maintained in an unfractured state by pivotally rotating the disk member onto the closure member while the polypropylene polymer is still at an elevated temperature so as to allow the connecting tab to be a tamper evidence indicator.

34. A slide type closure device as defined in claim 33 wherein the closure member planar surface has a substantially circular perimeter and wherein the disk member also has a substantially circular perimeter with a diameter less than that of the closure member planar surface by at least the diameter of the orifice forming member.

35. A slide type closure device as defined in claim 34 wherein the closure member comprises a pair of substantially parallel grooves formed within a recess in the planar upper surface of the closure member and wherein the disk member means for slidably engaging with the closure member comprises a pair of downwardly depending rails each having a transversely projecting ridge for interfitting with one of the grooves in the closure member.

36. A slide type closure as defined in claim 21 further wherein the axial length of the orifice forming member is slightly greater than the orifice diameter.

* * * * *